US006425680B1

(12) United States Patent
Rippel et al.

(10) Patent No.: US 6,425,680 B1
(45) Date of Patent: Jul. 30, 2002

(54) UNITARY REFLECTOR FOR A RECESSED MOUNTED LIGHTING FIXTURE

(75) Inventors: Graham M. Rippel, South Easton; Mark O. Jones, South Dartmouth, both of MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/657,652

(22) Filed: Sep. 7, 2000

(51) Int. Cl.[7] ..... F21V 17/00

(52) U.S. Cl. ..... 362/364; 362/350; 362/343; 362/304; 362/297

(58) Field of Search ..... 362/364, 365, 362/366, 368, 350, 343, 304, 297, 346

(56) References Cited

U.S. PATENT DOCUMENTS

| | | | | |
|---|---|---|---|---|
| 2,465,248 A | | 3/1949 | McCandless | |
| 2,998,511 A | | 9/1961 | Chan | |
| 3,375,368 A | | 3/1968 | Dorsky | |
| 3,518,420 A | | 6/1970 | Kripp | |
| 3,721,817 A | | 3/1973 | Contratto | |
| 4,475,147 A | * | 10/1984 | Kristofek | 362/148 |
| 4,518,896 A | | 5/1985 | Miles, Jr. | |
| 4,635,172 A | | 1/1987 | Steinke | |
| 4,703,406 A | | 10/1987 | Elliot et al. | |
| 4,872,097 A | | 10/1989 | Miller | |
| 4,947,297 A | | 8/1990 | Druffel et al. | |
| 5,440,471 A | | 8/1995 | Zadeh | |
| 5,584,575 A | | 12/1996 | Fickel | |
| 5,662,413 A | | 9/1997 | Akiyama | |
| 5,673,997 A | | 10/1997 | Akiyama | |
| 5,707,143 A | | 1/1998 | Hentz | |
| 5,758,959 A | | 6/1998 | Sieczkowski | |
| 5,826,970 A | * | 10/1998 | Keller et al. | 362/147 |
| 5,836,678 A | | 11/1998 | Wright et al. | |
| 5,857,766 A | | 1/1999 | Sieczkowski | |
| 5,957,573 A | | 9/1999 | Wedekind et al. | |
| 6,004,011 A | | 12/1999 | Sieczkowski | |

* cited by examiner

*Primary Examiner*—Sandra O'Shea
*Assistant Examiner*—Ronald E. DelGizzi
(74) *Attorney, Agent, or Firm*—Jeffrey A. Haeberlin; Middleton Reutlinger

(57) ABSTRACT

A unitary reflector trim to shield a viewer's line of sight past a lamp into a lighting fixture, eliminating the material and assembly expense of additional components. Included in the reflector trim are a cylindrical socket cup receiving neck which transitions into a waist section having a smaller diameter than the neck. A reflector section transitions from the waist section. A trim ring extends from the base of the reflector section to cover the edges of a ceiling opening. All of the elements are integral with each other, forming a single piece reflector trim.

6 Claims, 6 Drawing Sheets

UNITARY REFLECTOR FOR A RECESSED MOUNTED LIGHTING FIXTURE

BACKGROUND OF THE INVENTION

1. Field of the Invention

This invention relates to recessed lighting fixture reflector trims, and particularly to a unitary recessed lighting fixture reflector trim 2. Description of Prior Art The aesthetic appearance of a recessed fixture to an observer is a function of many factors. One important factor is the absence of distracting hardware and internal components of the unit. Blocking the line of site between the room side of the fixture and the internal hardware is typically accomplished by adding reflector trims to the aperture of the fixture.

Common reflector trims have a two or more piece construction. One outer housing portion, and one or more pieces, such as baffles, cones or rings, to shield the consumers' line of sight past the lamp into the lighting fixture. This construction increases material and assembly costs associated with the fixture.

SUMMARY OF THE INVENTION

Thus, it is an object of the present invention to provide a single piece reflector trim to shield the consumer's line of sight past the lamp into the lighting fixture, thereby eliminating any additional components and providing ease of assembly.

The preferred embodiment of the unitary recessed reflector trim of the present invention has a cylindrical socket cup receiving neck which transitions to a waist section. The waist section has a smaller diameter than the neck to block the line of sight between the room side of the fixture and the internal hardware. The preferred embodiment also has a reflector section which transitions from the waist section, and a trim ring around the base of the reflector section to cover the edges of the ceiling opening. All of the elements of the preferred embodiment are integral with each other, forming a single piece reflector trim which does not require a housing or fasteners to hold the elements together.

DETAILED DESCRIPTION OF THE PREFERRED EMBODIMENT

Figure 1:
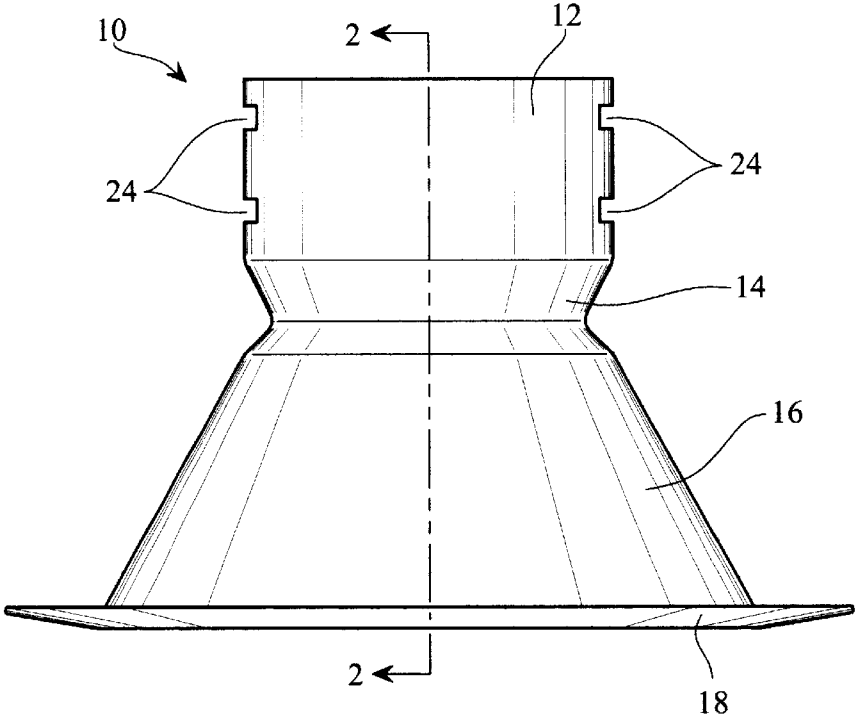
FIG. 1 is a side view of a preferred embodiment of a unitary recessed reflector trim of the current invention.

As shown in FIG. 1, the unitary reflector trim 10 of the present invention has a socket cup receiving neck 12, a waist section wall 14, a reflector section wall 16 and a trim ring 18. The elements are integral with each other.

In the preferred embodiment, the entire reflector trim may be a shaped aluminum product with a thickness of for example about 0.032". However, it should be recognized that other materials, such as polycarbonate or other plastic materials, or even steel, may be utilized in fabricating the reflector trim described herein.

Figure 2:
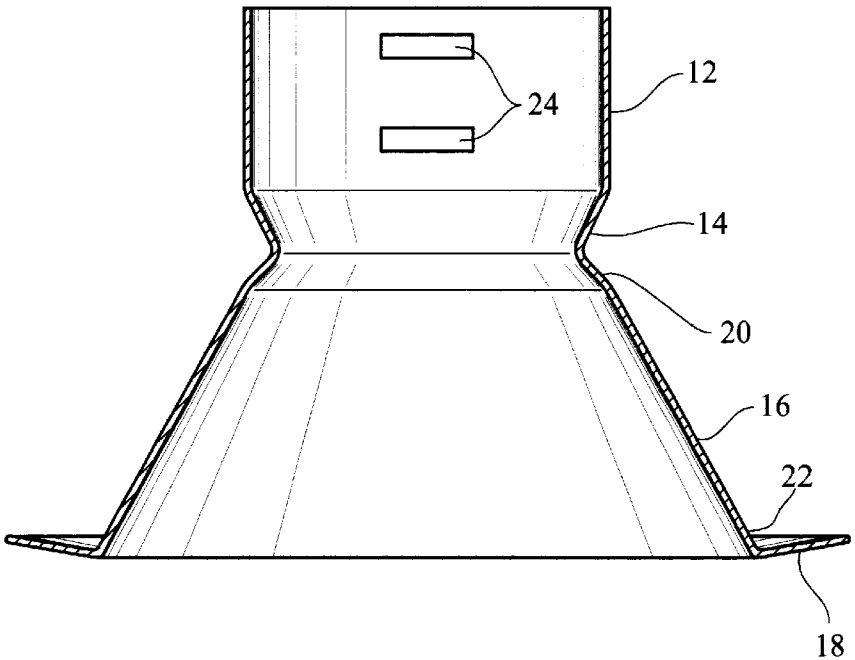
FIG. 2 is a sectional view taken along line 2—2 of FIG. 1.
Figure 3:
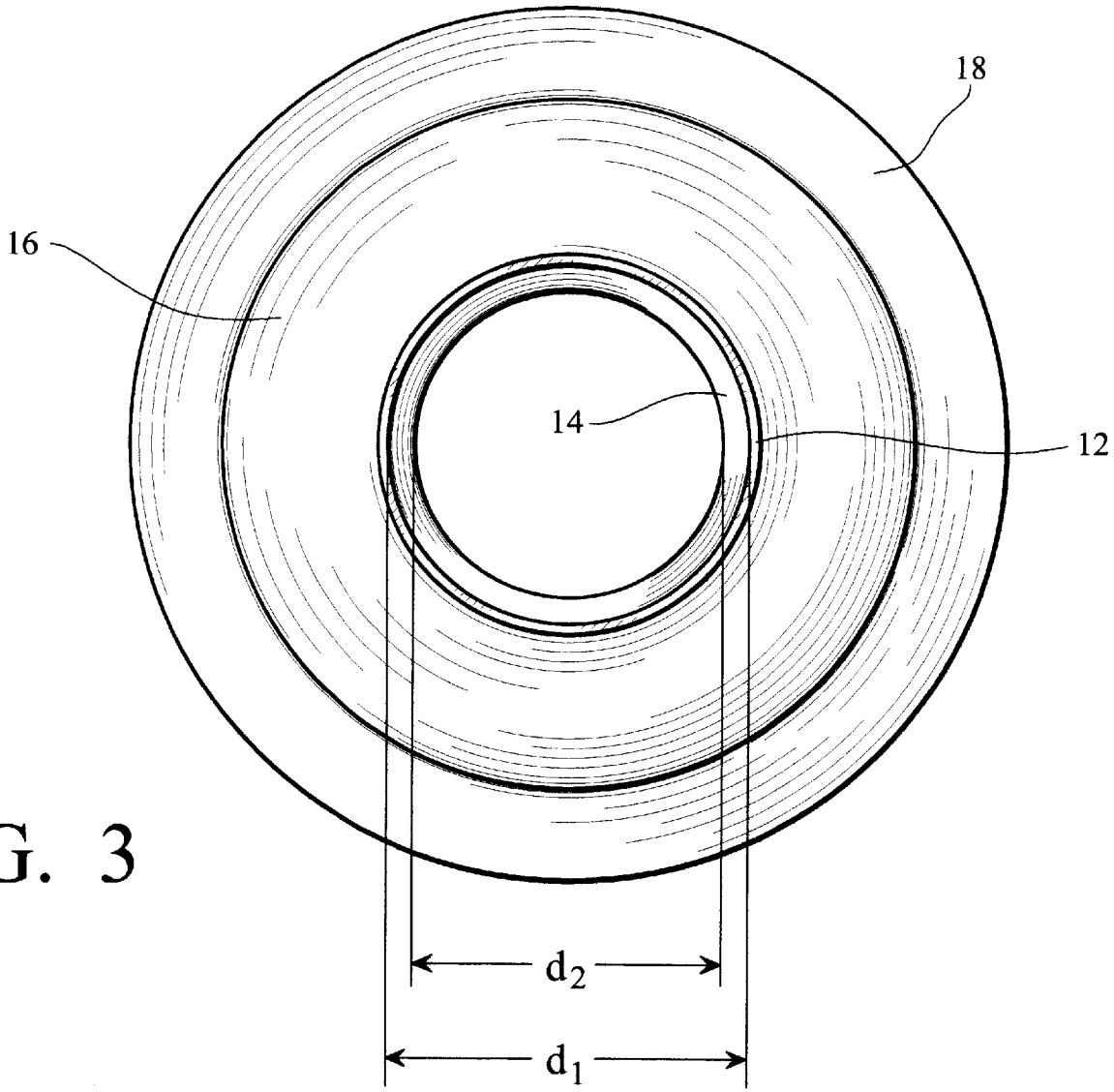
FIG. 3 is a top view of the unitary recessed reflector trim of FIG. 1.

As further shown in FIGS. 2 and 3, socket cup receiving neck 12 is substantially cylindrical, having a diameter, $d_1$. Waist section wall 14 tapers inward from socket cup receiving neck 12 to a diameter, $d_2$, which is smaller than $d_1$. Reflector section wall 16 has a top portion 20 and a base portion 22. Reflector section wall 16 meets the top portion 20 of waist section wall 14 and tapers outward to the bottom portion. Further, socket cup receiving neck has socket cup receiving tab slots 24 designed to engage the tabs on a socket cup (not shown).

Figure 9:
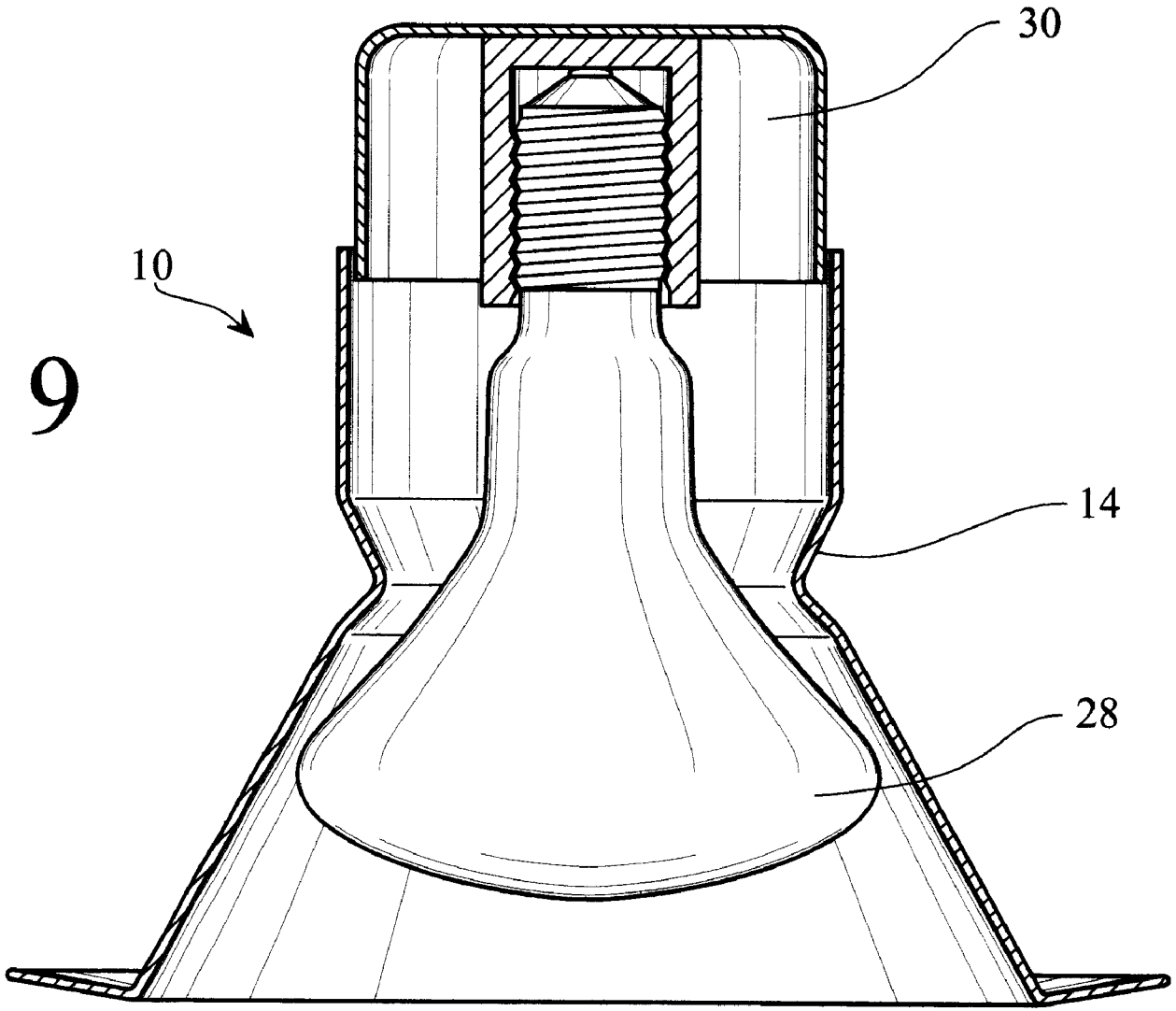
FIG. 9 is a side sectional view of the unitary recessed reflector trim of FIG. 1 also having a lamp and socket cup hardware assembled to the reflector trim.

In practice, as shown in FIG. 9, a lamp 28 is held in position within reflector trim 10 such that the waist section wall 14 fits behind or above the lowermost portion of the lamp 28. Thus, the line of sight from the room side of the reflector trim 10 to the socket cup hardware 30 is blocked by the waist section wall 14 in conjunction with the lamp 28.

Figure 4:
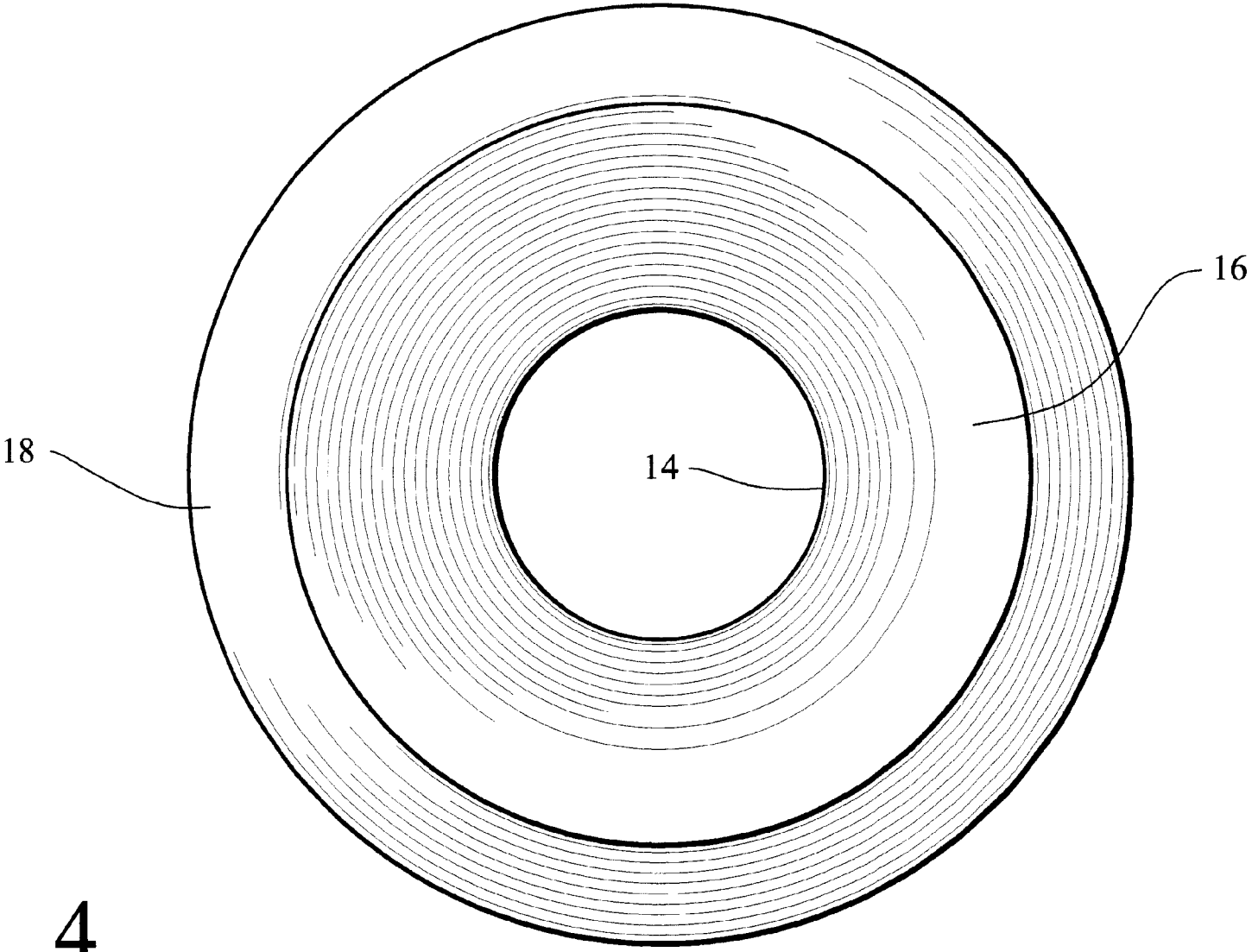
FIG. 4 is a bottom view of the unitary recessed reflector trim of FIG. 1.

As shown in FIG. 4, reflector section wall 16 tapers inward to meet waist section wall 14, thereby concealing socket cup receiving neck 12 when viewed from directly below. Further, trim ring 18 covers the edges of the ceiling opening into which the reflector trim 10 is installed. Thus, a the reflector trim 10 will provide a neatly finished appearance when viewed from below, with no edges, fasteners, or socket cup hardware in sight.

Figure 6:
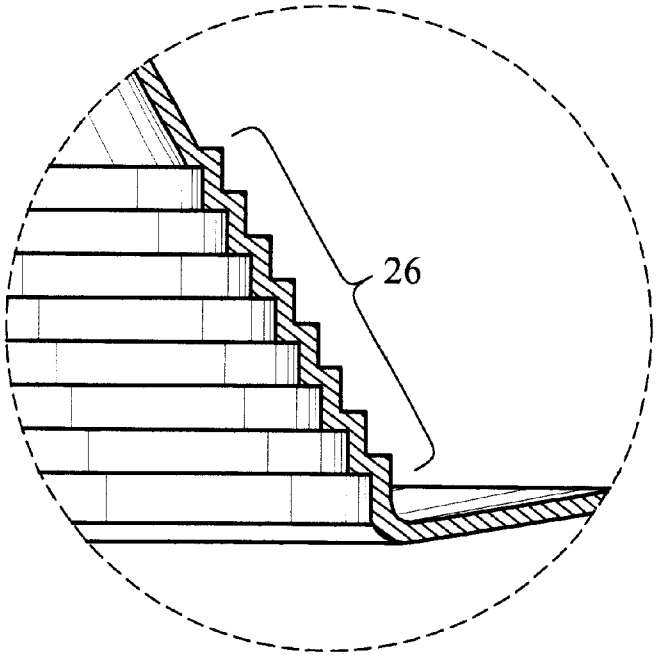
FIG. 6 is an enlarged sectional detail view of detail 6—6 of FIG. 5.
Figure 5:
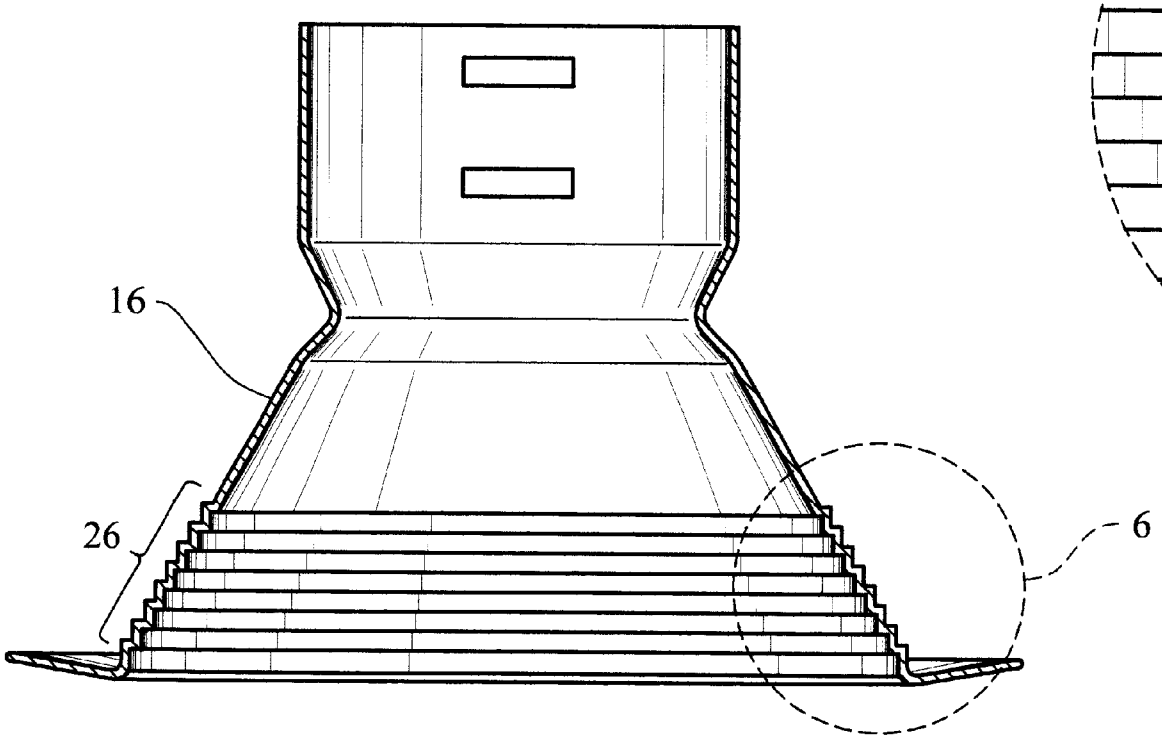
FIG. 5 is a side sectional view of another embodiment of a unitary recessed reflector trim of the current invention, being an equivalent view to the sectional view of FIG. 2.

FIG. 5 shows an embodiment of the unitary reflector trim wherein reflector section wall 16 has a stepped portion 26 to reduce glare from the reflector trim. FIG. 6 shows an enlarged detail view of the stepped portion 26 of the reflector section wall 16.

Figure 8:
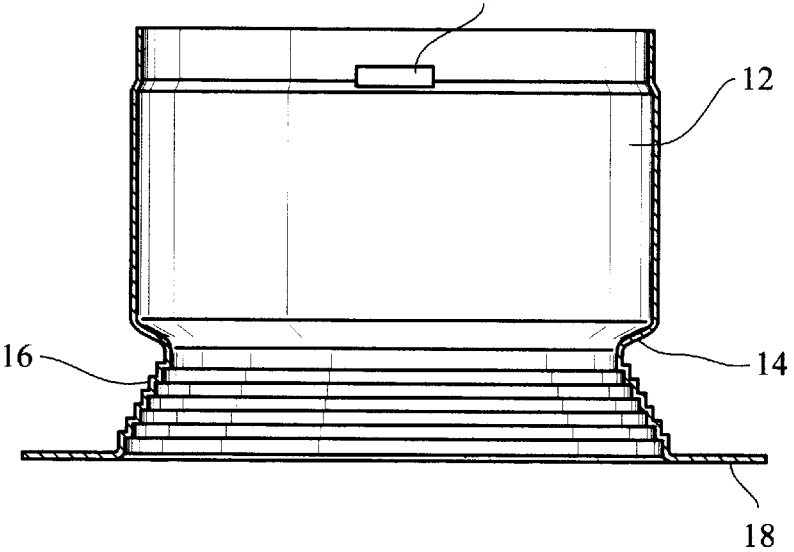
FIG. 8 is a side sectional view of even another embodiment of a unitary recessed reflector trim of the current invention, also being an equivalent view to the sectional view of FIG. 2.
Figure 7:
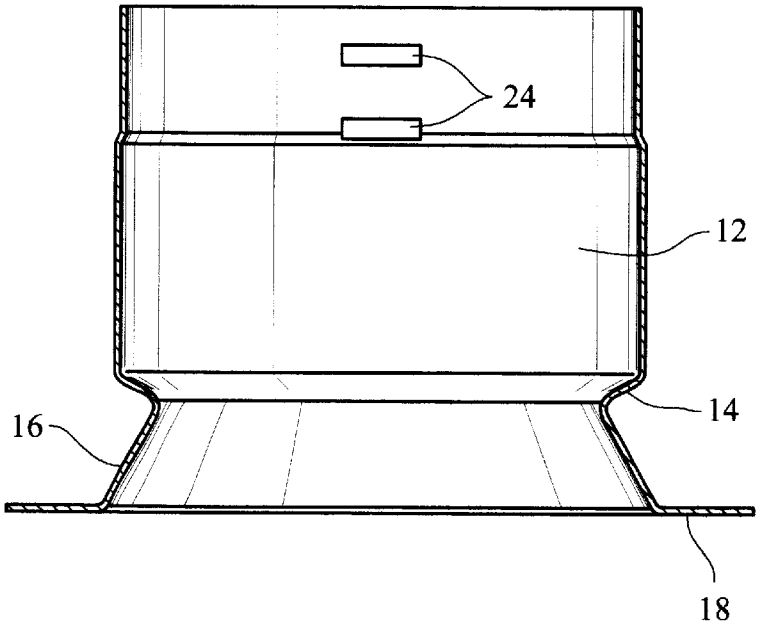
FIG. 7 is a side sectional view of yet another embodiment of a unitary recessed reflector trim of the current invention, also being an equivalent view to the sectional view of FIG. 2.

FIGS. 7 and 8 show additional embodiments of the unitary reflector trim of the invention. In these embodiments, socket cup receiving neck 12 is designed to hold a lamp (not shown) in place above waist section wall 14. Again, waist section wall 14 in cooperation with the lamp 28 will conceal socket cup hardware 30.

This detailed description is given primarily for clearness of understanding and no unnecessary limitations are to be understood therefrom for modifications will become obvious to those skilled in the art upon reading this disclosure and may be made without departing from the spirit of the present invention and scope of the appended claims.

What is claimed is:

1. A unitary reflector trim comprising:

a substantially cylindrical socket cup receiving neck having a first diameter;

a waist section wall integral with and extending downwardly from said socket cup receiving neck, said waist section wall having a second diameter, said second diameter being less than said first diameter;

a reflector section wall integral with and extending downwardly from said waist section wall, said reflector section wall having a top portion and a base portion; and a trim ring integral with and extending around the reflector section wall base portion.

2. The reflector trim of claim 1, the socket cup receiving neck having at least one socket cup tab receiving slot.

3. The reflector trim of claim 2, the socket cup receiving neck having upper and lower socket cup tab receiving slots.

4. The reflector trim of claim 1, the waist section wall having an inward taper from said socket cup receiving neck first diameter to the location of said waist section wall second diameter.

5. The reflector trim of claim 1, the reflector section wall tapering outward from said top portion to said base portion.

6. The reflector trim of claim 5, the reflector section wall further having a stepped portion.

* * * * *